US005159721A

United States Patent [19]

Senser et al.

[11] Patent Number: 5,159,721

[45] Date of Patent: Nov. 3, 1992

[54] FIREFIGHTER'S TROUSERS PROVIDING EXCEPTIONAL FREEDOM OF LEG MOVEMENT

[75] Inventors: Karl E. Senser, Camano Island, Wash.; Patricia K. Lewis, Huber Heights, Ohio

[73] Assignees: William L. Grilliot; Mary I. Grilliot, both of Dayton, Ohio

[21] Appl. No.: 735,432

[22] Filed: Jul. 25, 1991

[51] Int. Cl.[5] ..... A41D 1/06

[52] U.S. Cl. ..... 2/227; 2/79; 2/81; 2/243 B

[58] Field of Search ..... 2/79, 81, 227, 243 B, 2/243 R

[56] References Cited

U.S. PATENT DOCUMENTS

| | | | |
|---|---|---|---|
| 179,661 | 7/1876 | Lee | 2/227 |
| 465,319 | 12/1891 | Clark | 2/227 |
| 924,013 | 6/1909 | Stecker | 2/227 |
| 1,277,700 | 9/1918 | Decker et al. | 2/227 |
| 2,264,958 | 12/1941 | Smith | 2/227 |
| 2,416,857 | 3/1947 | Trinkel | 2/227 |
| 3,745,589 | 7/1973 | Borsing | 2/227 |
| 3,763,498 | 10/1973 | Rector | 2/79 |
| 3,793,646 | 2/1974 | Tempelhof | 2/227 |
| 4,004,297 | 1/1977 | Polack | 2/227 |
| 4,035,844 | 7/1977 | Atack | 2/227 |
| 4,261,060 | 4/1981 | Zawacki | 2/227 |
| 4,301,546 | 11/1981 | de Polo | 2/243 B |
| 4,371,989 | 2/1983 | Polsky | 2/227 |
| 4,392,259 | 7/1983 | Bredo | 2/227 |
| 4,494,250 | 1/1985 | Sheppard | 2/243 R |
| 4,613,991 | 9/1986 | Grover | 2/227 |
| 4,619,004 | 10/1986 | Won | 2/227 |
| 4,669,130 | 6/1987 | Brown | 2/227 |
| 4,670,913 | 6/1987 | Morell | 2/227 |
| 4,722,099 | 2/1988 | Kratz | 2/227 |
| 4,922,552 | 5/1990 | Grilliot | 2/81 |
| 4,989,272 | 2/1991 | Wagner | 2/243 B |
| 5,033,123 | 7/1991 | Audet | 2/227 |

FOREIGN PATENT DOCUMENTS

| | | | |
|---|---|---|---|
| 655354 | 1/1963 | Canada | 2/227 |
| 2303492 | 10/1976 | France | 2/227 |
| 385935 | 3/1931 | United Kingdom | 2/227 |
| 1061920 | 3/1967 | United Kingdom | 2/227 |

OTHER PUBLICATIONS

Janesville, Freedom Series Commando Turnouts.

*Primary Examiner*—Werner H. Schroder
*Assistant Examiner*—Diana L. Biefeld
*Attorney, Agent, or Firm*—Jacox & Meckstroth

[57] ABSTRACT

A firefighter's trousers of the type constructed of firefighting protective material. The firefighter's trousers have a torso section and a pair of leg sections. The torso section and the leg sections are joined by one or more panels which form a crotch region in the firefighter's trousers. Therefore, there is no conventional center seam in the crotch region, and the life of the firefighter's trousers is enhanced. Also, during leg movement of the firefighter who wears the firefighter's trousers there is no strain between the leg sections and the torso section. Therefore, the firefighter's trousers of the invention minimize the stress upon the firefighter and the comfort in the wearing of the firefighter's trousers is enhanced.

3 Claims, 5 Drawing Sheets

FIREFIGHTER'S TROUSERS PROVIDING EXCEPTIONAL FREEDOM OF LEG MOVEMENT

BACKGROUND OF THE INVENTION

As a firefighter is engaged in firefighting the legs of the firefighter are actively moved.

A conventional firefighter's trousers have a seam in the crotch region which maintains portions of the firefighter's trousers together adjacent the crotch region. Therefore, when a firefighter is wearing conventional firefighter's trousers, movement of the firefighter's legs results in strain or tension between the leg portions of the firefighter's trousers and the torso portion of the firefighter's trousers. Such strain between the leg portions of the firefighter's trousers and the torso portion of the firefighter's trousers causes the firefighter to expend energy in excess of the normal energy required to move the firefighter's legs and leg portions of the firefighter's trousers.

Also, the strain which is created between the leg portions and torso portion of a firefighter's trousers usually results in eventual tearing or ripping of seams in the crotch region and/or other regions of the firefighter's trousers. Thus, the life of the firefighter's trousers may be limited.

Furthermore, the strain which is created between the leg portions and the torso portion causes a degree of discomfort to the firefighter who wears the firefighter's trousers.

Therefore, the structure of conventional trousers of a firefighter has objectionable features.

It is an object of this invention to provide a firefighter's trousers having structural features which permit leg movement of the firefighter without causing strain between the leg portions and torso portion of the firefighter's trousers. Therefore, the firefighter's legs can move without creating unnecessary stress upon the firefighter.

It is another object of this invention to provide such firefighter's trousers which have long life.

Another object of this invention is to provide a firefighter's trousers which are comfortable to the wearer of the firefighter's trousers in all activities of the wearer.

It is another object of this invention to provide such firefighter's trousers without significantly increasing the amount of material which is normally found in a firefighter's trousers.

Another object of this invention is to provide such trouser structure which can be employed in construction of trousers which are not a firefighter's trousers.

Other objects and advantages of this invention reside in the construction of parts, the combination thereof, the method of construction and the method of use, as will become more apparent from the following description.

U.S. Pat. Nos. 4,864,655 and 5,010,591 disclose firefighters' garments which are designed to minimize resistance to arm movements. However, the structural features thereof are different from the structural features of the firefighter's trousers of this invention.

SUMMARY OF THE INVENTION

This invention comprises a firefighter's trousers which include firefighting protective material, such as abrasion resistant material, flame resistant material, thermal barrier material, and moisture barrier material.

These materials may be in the form of one layer or a plurality of layers.

The firefighter's trousers of this invention include a pair of sections. Each section includes a leg portion and a torso portion. One or more connection panels are joined to the leg portions and to the torso portion and form a crotch region. The connection panel or panels are of a size and shape and are positioned to create no significant strain between the leg portions and the torso portion when the legs of the firefighter who wears the firefighter's trousers are moved. Therefore, no appreciable or significant strain or tension occurs between the leg portions and the torso portion as the firefighter's legs are moved.

Therefore, the firefighter is not required to exert unnecessary energy which would occur if a strain should occur between the leg portions and torso portion of the firefighter's trousers. Therefore, the firefighter's legs can be moved freely and independently of the torso portion of the firefighter's trousers. Thus, any stress upon the firefighter as a result of leg movement of the firefighter is primarily limited to the leg movement of the firefighter and to movement of the leg portions of the firefighter's trousers.

Such structure of the firefighter's trousers minimizes the possibility of tearing of seams in the crotch region and in adjacent portions of the firefighter's trousers.

Also, such structure of the firefighter's trousers permits the firefighter's trousers to be worn with maximum comfort to the firefighter.

DETAILED DESCRIPTION OF THE INVENTION

Figure 1:
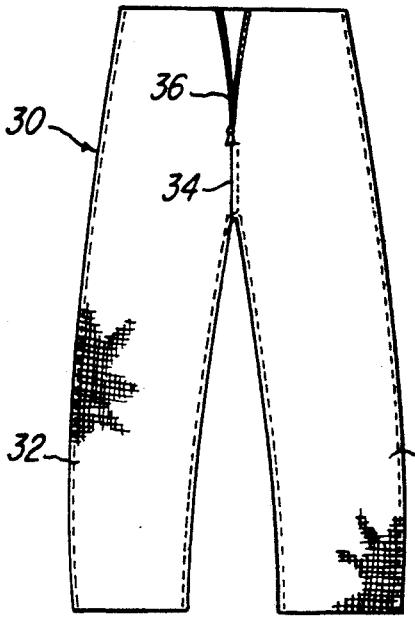
FIG-1 (PRIOR ART)
FIG. 1 is a front elevational view of a conventional or prior art firefighter's trousers.
Figure 2:
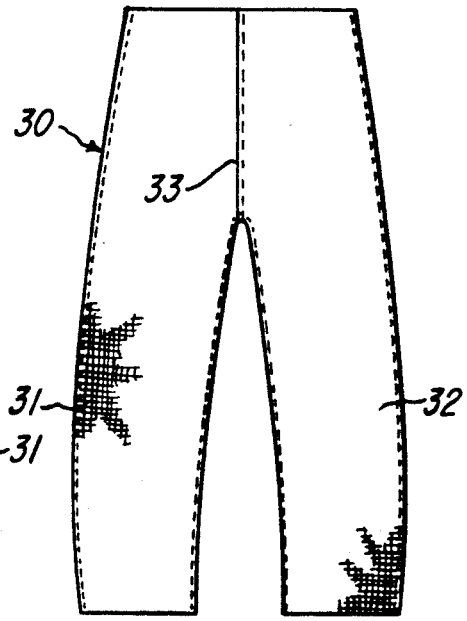
FIG-2 (PRIOR ART)
FIG. 2 is a rear elevational view of the conventional or prior art firefighter's trousers shown in FIG. 1.

FIGS. 1–5 show a conventional firefighter's trousers 30. The conventional firefighter's trousers 30 include a left section 31 and a right section 32. The lower part of each section 31 and 32 includes a leg portion, and the upper part of each section 31 and 32 includes a torso portion. A seam 33 joins parts of the torso portions together at the rear part of the firefighter's trousers 30. A seam 34 joins the torso portions together at the front part of the firefighter's trousers 30. Above the seam 34 the two torso portions are releasably attachable together by any suitable means, such as by means of a slide fastener 36 or the like.

Figure 3:
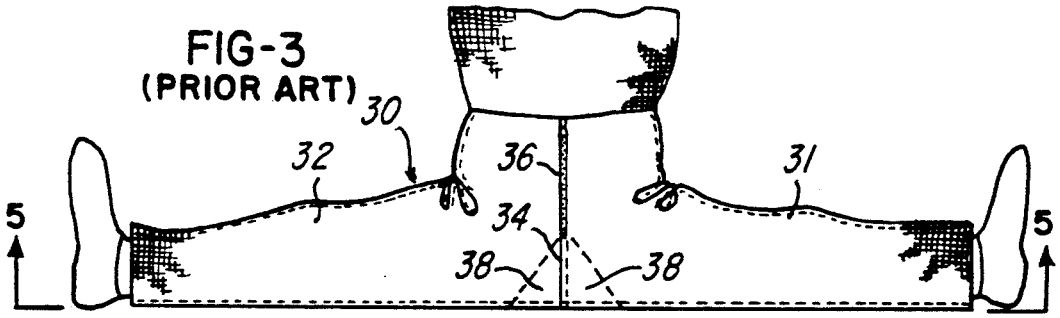
FIG-3 (PRIOR ART)
FIG. 3 is a front elevational view showing the conventional firefighter's trousers of FIGS. 1 and 2 as the firefighter's trousers are worn by a firefighter. This view also shows a portion of the firefighter who wears the firefighter's trousers. This view illustrates that a significant strain region is created between the leg portions and the torso portion of the firefighter's trousers in extreme leg positions of the firefighter.
Figure 4:
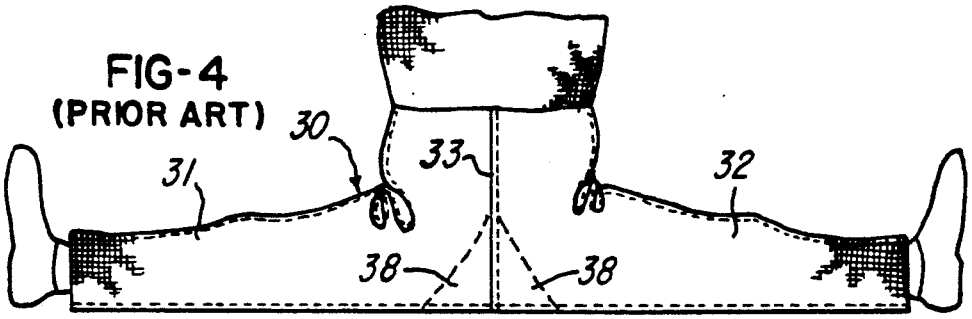
FIG-4 (PRIOR ART)
FIG. 4 is a rear elevational view showing the firefighter's trousers of FIGS. 1, 2 and 3. This view also illustrates the strain region which is created between the leg sections and the torso when the legs of the firefighter are positioned as illustrated in FIG. 3.
Figure 5:
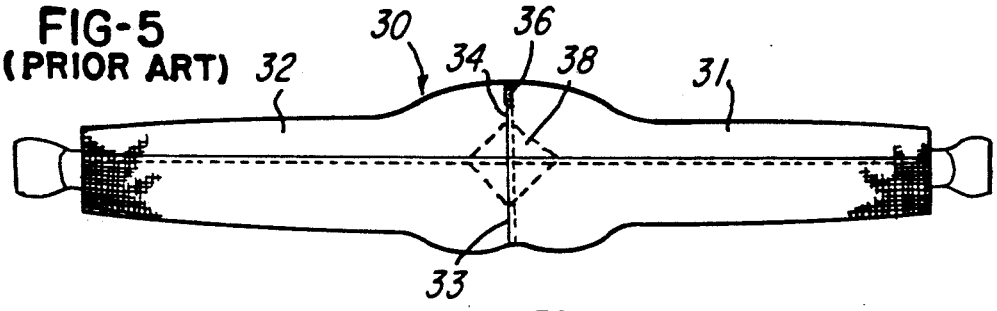
FIG-5 (PRIOR ART)
FIG. 5 is a bottom view taken substantially on line 5—5 of FIG. 3. This view also illustrates the strain region created in the firefighter's trousers when the firefighter's legs are positioned as shown in FIGS. 3 and 4.
Figure 10:
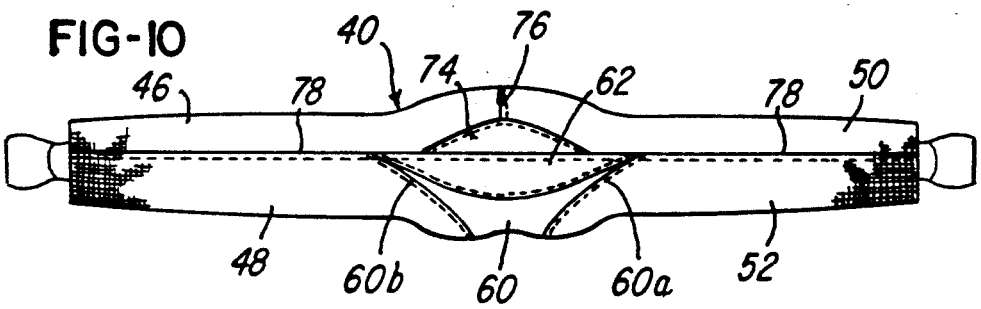
FIG. 10 is a bottom view of the firefighter's trousers taken substantially on line 10—10 of FIG. 8, showing the firefighter's legs positioned as shown in FIGS. 8 and 9.

Therefore, when the legs of the firefighter are moved to any position, such as to the position illustrated in FIGS. 3, 4, and 5, a strain area 38 occurs in the crotch region of the trousers 30, as illustrated in FIGS. 3, 4, and 5. When the strain area 38 occurs, leg movement of the firefighter requires additional energy to move the leg portions of the firefighter's trousers 30 with respect to the torso portion. Furthermore, the strain area 38 creates a tension in the seams 33 and 34 which may shorten the life of the seams 33 and 34. Also, the strain area 38 which occurs, as illustrated, creates a discomfort to the firefighter who wears the firefighter's trousers 30. Therefore, the conventional firefighter's trousers 30 shown in FIGS. 1, 2, 3, 4, and 5 have objectional constructional features.

THIS INVENTION

Figure 6:
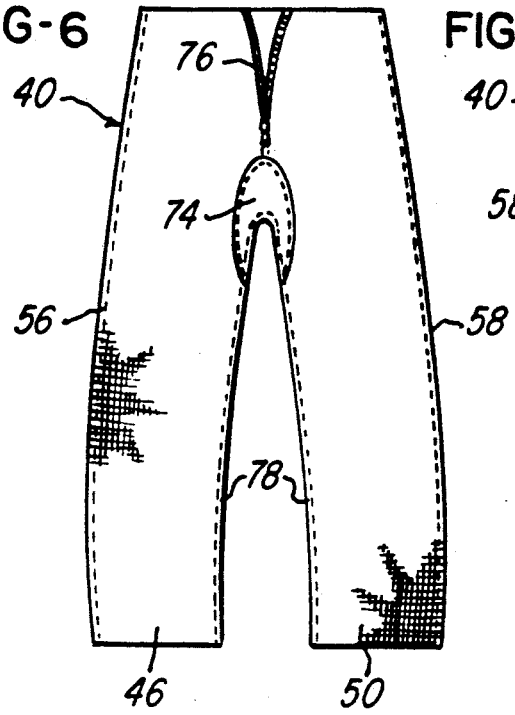
FIG. 6 is a front elevational view showing a firefighter's trousers of this invention.
Figure 7:
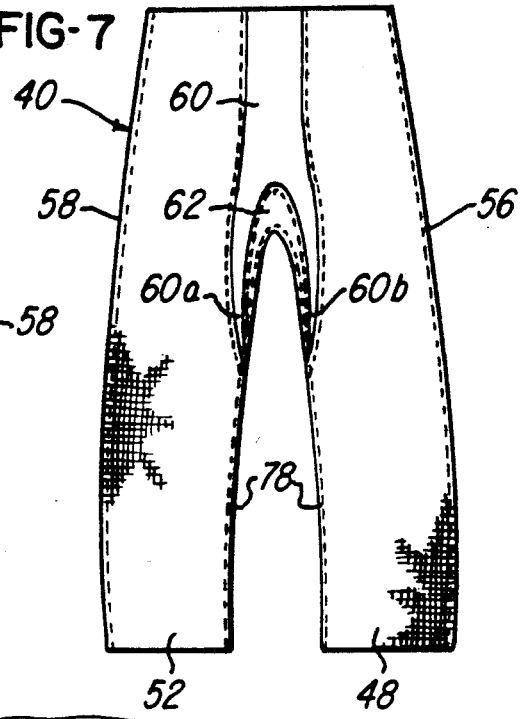
FIG. 7 is a rear elevational view of the firefighter's trousers of FIG. 6.

FIG. 6 is a front elevational view of firefighter's trousers 40 of this invention. FIG. 7 is a rear elevational view of the firefighter's trousers 40 of this invention. This firefighter's trousers 40 comprise firefighting protective material, such as abrasion resistant material, flame resistant material, thermal barrier material, and moisture barrier material.

Figure 8:
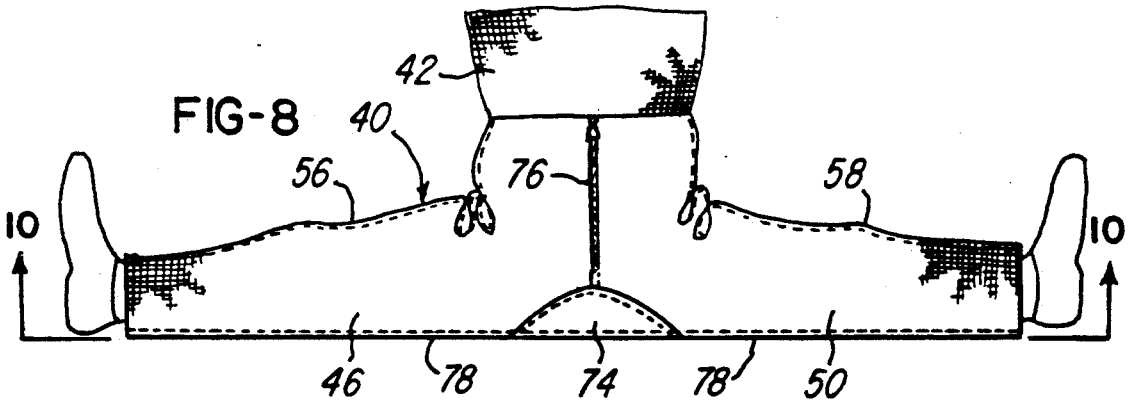
FIG. 8 is a front elevational view showing the firefighter's legs in the extreme leg positions illustrated in FIGS. 3, 4, and 5. This view shows that the firefighter's trousers of this invention do not have a strain region therein when the firefighter's legs are so positioned.
Figure 9:
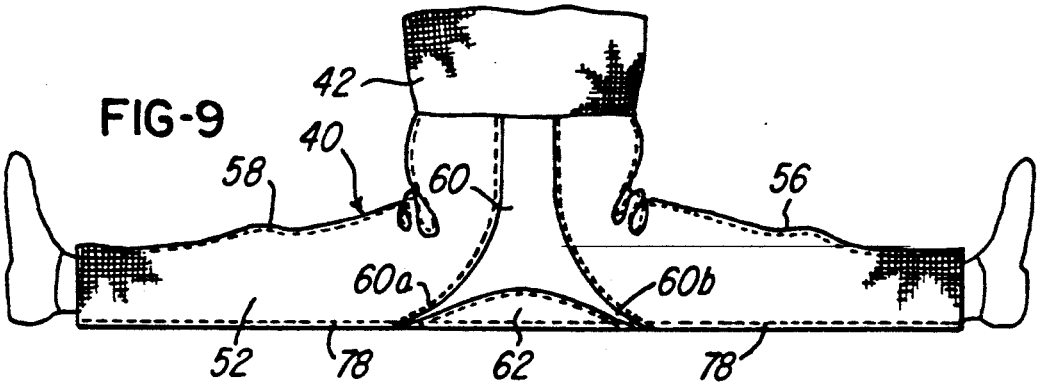
FIG. 9 is a rear elevational view of the firefighter's trousers of FIGS. 6, 7, and 8 when the firefighter's legs are positioned as shown in FIG. 8.

FIGS. 8 and 9 show a body portion 42 of the firefighter who wears the firefighter's trousers 40.

FIGS. 10, 11, 12, 13, 14, and 15 show the details of the structural features and the construction of the firefighter's trousers 40 of this invention.

Figure 11:
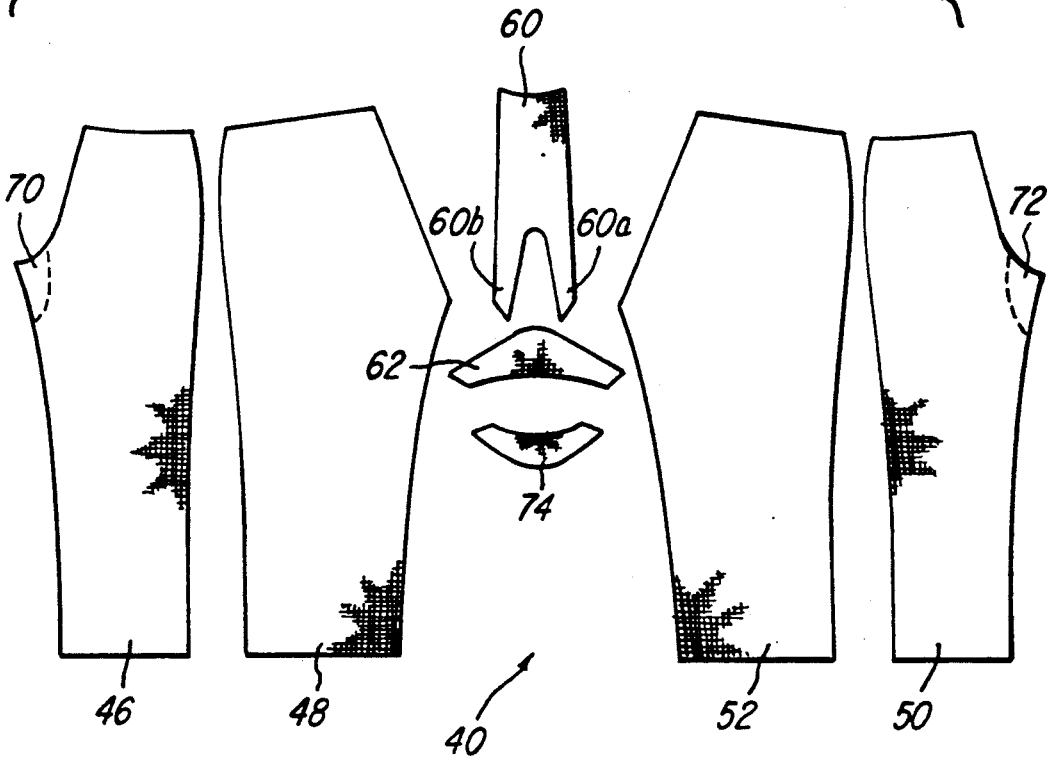
FIG. 11 is a layout type of view showing the portions of the firefighter's trousers of FIGS. 6–10.
Figure 12:
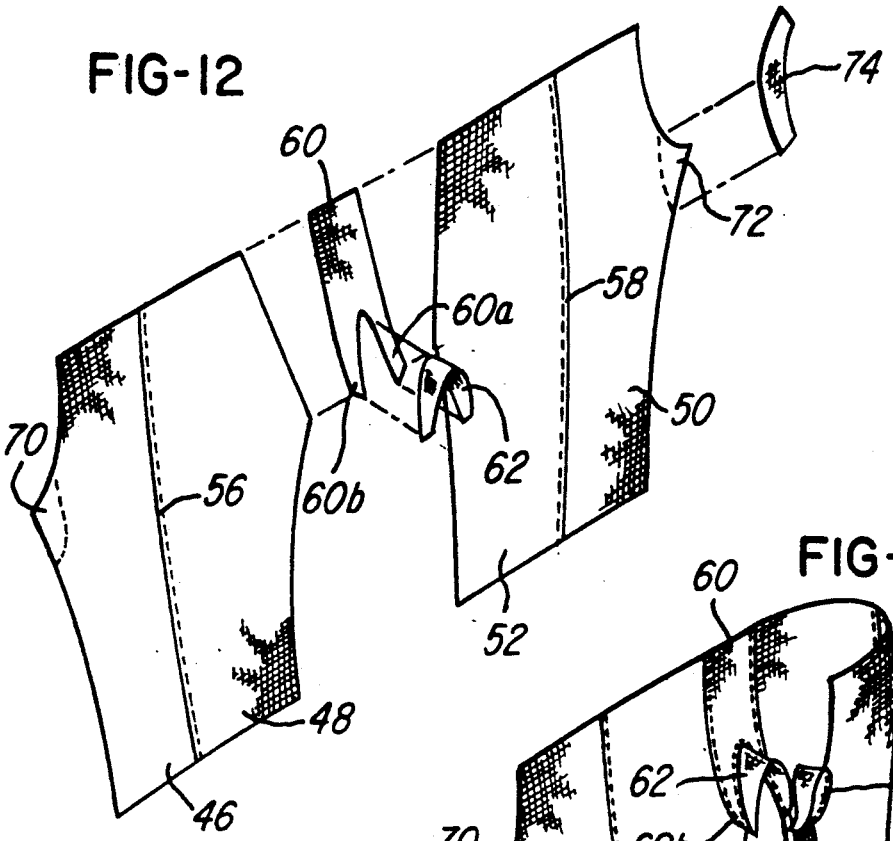
FIG. 12 is a perspective type of layout view showing the portions of the firefighter's trousers illustrated in FIG. 11 and showing some of the portions attached together and illustrating the manner in which other portions of the firefighter's trousers are attached together.

As shown in FIGS. 11 and 12, the firefighter's trousers 40 comprise a right front section 46 and a right rear section 48. The trousers 40 also comprise a left front section 50 and a left rear section 52.

The right front section 46 and the right rear section 48 are joined together by a seam 56, shown in FIGS. 12–15. The left front section 50 and the left rear section 52 are joined together by a seam 58 as best shown in FIG. 12.

Figure 13:
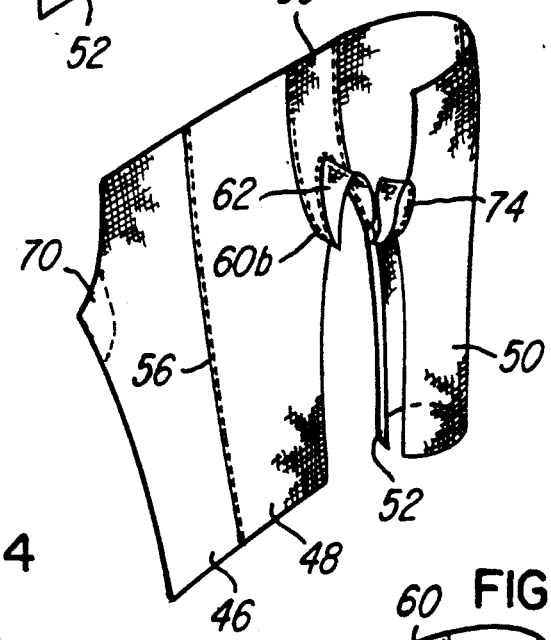
FIG. 13 is a perspective view illustrating another step in the construction of the firefighter's trousers of this invention.

A center seat panel 60 joins the upper portion of the right rear section 48 to the upper portion of the left rear section 52. The center seat panel 60 has two spaced-apart stems 60*a* and 60*b*. A connection panel 62 is bent into a U-shape and is positioned between the two spaced-apart stems 60*a* and 60*b* of the center seat panel 60, as illustrated in FIG. 12. The connection panel 62 is attached to the spaced-apart stems 60*a* and 60*b* of the center seat panel 60 and is also attached to the right rear section 48 and to the left rear section 52, as illustrated in FIG. 13.

Figure 14:
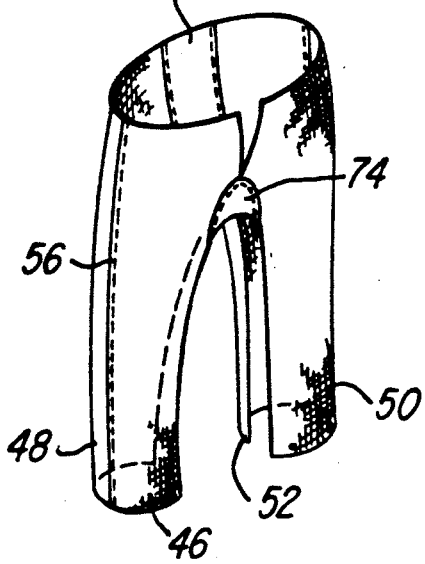
FIG. 14 is a perspective view showing still another step in the construction of the firefighter's trousers of this invention.
Figure 15:
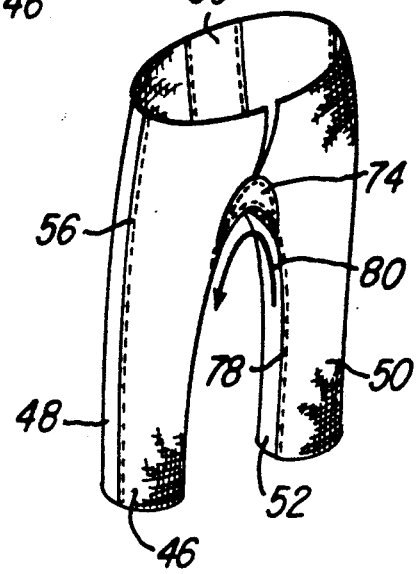
FIG. 15 is a perspective view showing still another step in the construction of the firefighter's trousers of this invention.
Figure 16:
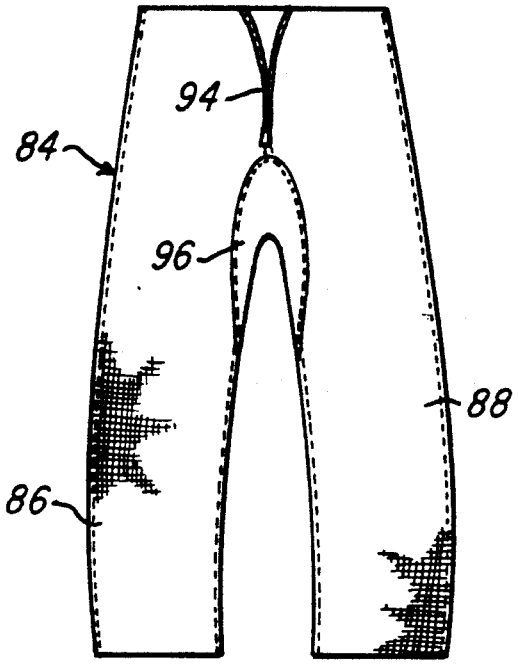
FIG. 16 is a front elevational view showing another embodiment of the firefighter's trousers of this invention.
Figure 17:
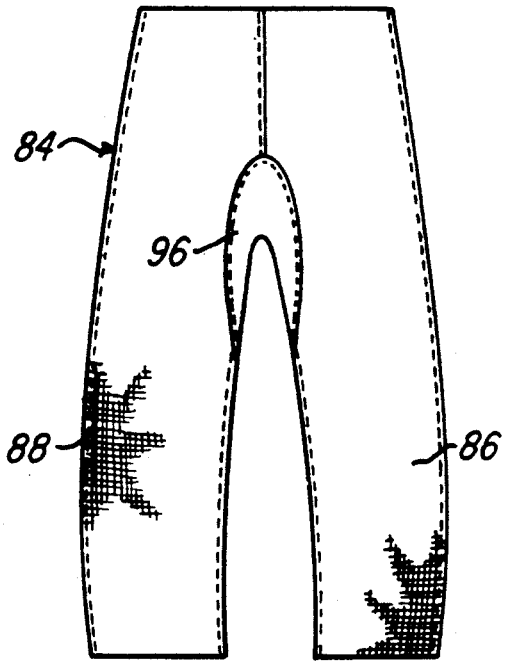
FIG. 17 is a rear elevational view showing the firefighter's trousers of FIG. 16.

The right front section 46 has a protuberant portion 70. The left front section 50 has a protuberant portion 72. A panel 74 is attached to the protuberant portion 70 of the front right section 46 and to the protuberant portion 72 of the left front section 50. The left front section 50 and the left rear section 52 are arranged in tubular formation, and the right front section 46 and the right rear section 48 are arranged in tubular formation as shown in FIG. 14. Then, a seam 78 attaches the left front section 50 and the left rear section 52 together and attaches the right front section 46 and the right rear section 48 together as shown in FIG. 15. The seam 78 may be a continuous seam as illustrated by an arrow 80 in FIG. 15. Seams including the seam 78 also attach the panels 60, 62, and 74 to the front left section 50 and to the front right section 46 and to the rear left section 48 and to the left front section 50.

The panels 60, 62, and 74 comprise firefighting protective material.

The upper part of the sections 46, 48, 50, and 52 are referred to herein as being a torso region, and the lower part of the sections 46, 48, 50, and 52 are referred to herein as leg regions.

Thus, the panels 60, 62, and 74 form a crotch region in the firefighter's trousers 40 and connect the leg regions to the torso region.

The upper parts of the torso region formed by the front sections 46 and 50 are releasably attachable together by any suitable means, such as by slide fastener means 76, as shown in FIGS. 6 and 8. The torso parts which are attached together by the slide fastener means 76 extend downwardly from the upper edge of the trousers 30 to a position adjacent the panel 74.

Therefore, there is no center seam in the crotch region of the firefighter's trousers 40. Furthermore, the panels 60, 62, and 74 provide for complete freedom of movement of the leg regions with respect to the torso region.

Therefore, when the legs of the firefighter are moved even when the legs of the firefighter are spread to extreme positions, such as illustrated in FIGS. 8 and 9, there is no strain between the leg regions and the torso region. Therefore, the firefighter's trousers 40 are comfortable to the wearer thereof in all positions of the legs of the firefighter. Also, the firefighter's trousers 40 are not subject to tearing of seams in the firefighter's trousers, and therefore, the firefighter's trousers 40 have long life. Also, due to the fact that there is no strain between the leg regions and the torso region in any position of the firefighter's legs, the firefighter is not required to exert unnecessary effort. The firefighter's legs and leg region can be moved freely and independently of the torso region of the firefighter's trousers. Thus, any stress upon the firefighter as a result of leg movement is primarily limited to the leg movement of the firefighter and to the movement of the leg regions of the firefighter's trousers.

FIGS. 16–20

FIGS. 16–20 show another embodiment of the firefighter's trousers of this invention. The firefighter's trousers 84 shown in FIGS. 16–20 comprise firefighting protective material and include a right section 86 and a left section 88. The lower portion of the sections 84 and 86 is considered herein as being a leg region, and the upper portion of the sections 86 and 88 is considered as being a torso region.

Figure 18:
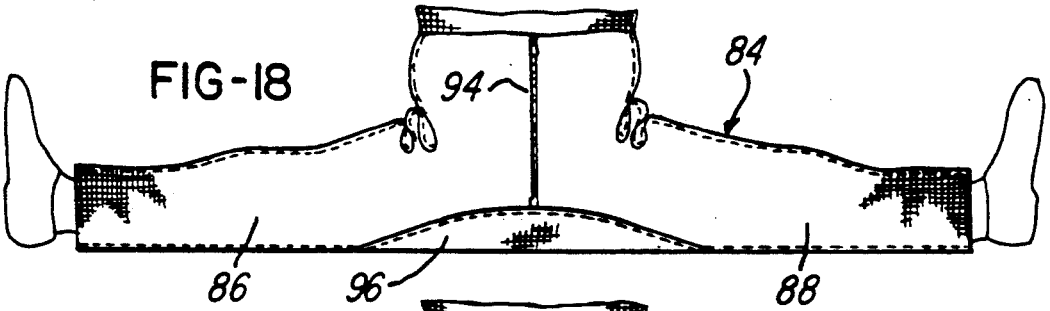
FIG. 18 is a front elevational view showing the firefighter's trousers of FIGS. 16 and 17 when the firefighter's legs are positioned in extreme spread positions.
Figure 19:
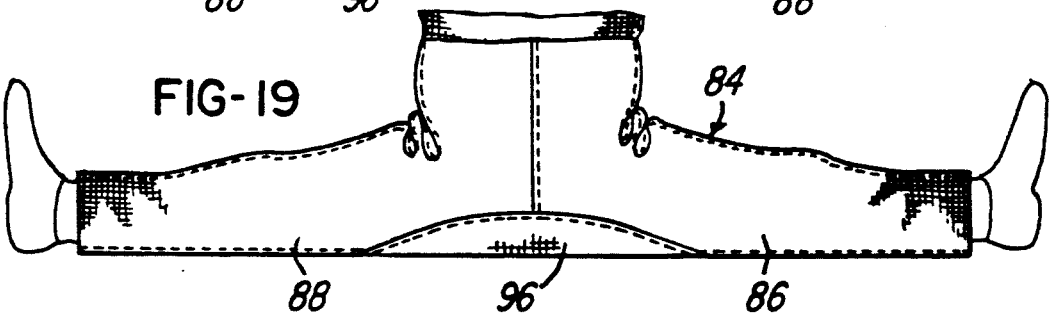
FIG. 19 is a rear elevational view of the firefighter's trousers of FIGS. 16, 17, and 18 showing the firefighter's trousers when the firefighter's legs are positioned in the manner shown in FIG. 18.
Figure 20:
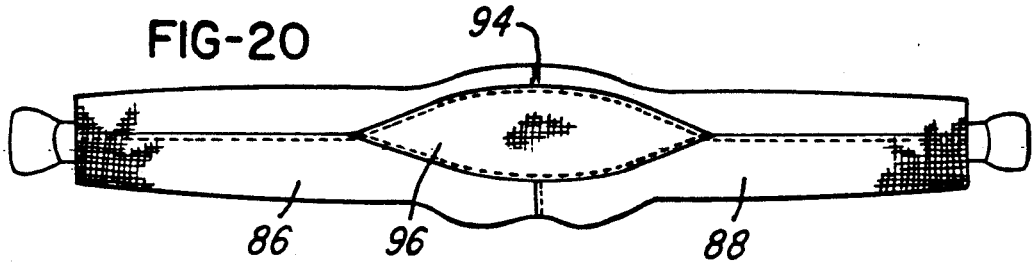
FIG. 20 is a bottom view of the firefighter's trousers of FIGS. 16, 17, 18, and 19 showing the trousers when the legs of the firefighter are positioned as shown in FIGS. 18 and 19.

The torso region has a front portion in which the sections 86 and 88 are releasably attachable together by any suitable means, such as by means of slide fastener means 94. Joining the left section 88 to the right section 86, and forming a crotch region in the firefighter's trousers 84, is a panel 96 which comprises firefighting protective material. As shown in FIG. 20, the panel 96 is somewhat football shape. However, the shape of the panel 96 is not critical and may be any desirable or suitable shape. The panel 96 extends upwardly at the front of the torso portion to a position closely adjacent the slide fastener means 94. Thus, there is no center seam in the crotch region. Therefore, the panel 96 provides for complete freedom of movement of the leg regions independent of the torso region. Thus, the firefighter who wears the firefighter's trousers 84 can have complete freedom of leg movement, even to an extreme leg position as shown in FIGS. 18, 19, and 20, without creating a strain between sections 86 and 88 and without creating a strain between the torso region and the leg regions of the firefighter's trousers 84.

Therefore, it is understood that a firefighter's trousers of this invention are capable of adequately and properly protecting a firefighter against the severe conditions which exist during firefighting. The firefighter's trousers of this invention also permit the firefighter's legs to be moved to any position without creating strain within any portion of the firefighter's trousers. Therefore, there is no unnecessary stress upon the firefighter. Also, due to the fact that the crotch region does not have a conventional center seam, the life of the firefighter's trousers is maximum, and the comfort experienced by the firefighter is maximum.

It is also to be understood that the trouser construction disclosed herein may be employed in the construction of trousers other than firefighter's trousers.

Although the preferred embodiment of the trousers of this invention have been described, it will be understood that within the purview of this invention various changes may be made in the form, details, proportion and arrangement of parts, the combination thereof, the method of construction, and the mode of use, which generally stated consist in trousers within the scope of the appended claims.

The invention having thus been described, the following is claimed:

1. A firefighter's trousers comprising firefighting protective material including abrasion resistant material, flame resistant material, thermal barrier material, and moisture barrier material, the firefighter's trousers including a right section and a left section, the right section having a front part and a rear part, the left section having a front part and a rear part, the left section having a torso part and a leg part, the right section having a torso part and a leg part, panel means attaching the right section to the left section and forming a crotch region in the firefighter's trousers between the torso parts and the left parts, the panel means comprising a plurality of pieces in which one of the pieces includes two spaced-apart stems and in which another of the pieces has a part positioned between the spaced-apart stems, whereby the leg parts are readily relatively movable, and whereby there is minimal strain between the leg parts and the torso part of the firefighter's trousers in all positions of the leg parts with respect to the torso parts of the firefighter's trousers, and whereby the firefighter's trousers are comfortable to the wearer thereof in all positions of the leg parts of the firefighter's trousers with respect to the torso parts, and whereby the life of the firefighter's trousers is maximum, and whereby stress with regard to leg movement is minimal in the firefighter who wears the firefighter's trousers.

2. A firefighter's trousers comprising firefighting protective material including abrasion resistant material, flame resistant material, thermal barrier material, and moisture barrier material, the firefighter's trousers including a right section and a left section, the right section having a front part and a rear part, the left section having a front part and a rear part, the left section having a torso part and a leg part, the right section having a torso part and a leg part, panel means attaching the right section to the left section and forming a crotch region in the firefighter's trousers between the torso parts and the leg parts, the rear part of the left section having an upper edge, the rear part of the right section having an upper edge, the panel means including a rear piece which has an upper edge adjacent the upper edge of the right part of the left section and adjacent the upper edge of the rear part of the right section, the rear piece of the panel means including a lower part which has a pair of spaced-apart portions, the panel means including an intermediate piece which attaches the spaced-apart portions of the rear piece to the front part of the right section and to the front part of the left section, whereby the leg parts are readily relatively movable, and whereby there is minimal strain between the leg parts and the torso part of the firefighter's trousers in all positions of the leg parts with respect to the torso parts of the firefighter's trousers, and whereby the firefighter's trousers are comfortable to the wearer thereof in all positions of the leg parts of the firefighter's trousers with respect to the torso parts, and whereby the life of the firefighter's trousers is maximum, and whereby stress with regard to leg movement is minimal in the firefighter who wears the firefighter's trousers.

3. The method of producing a firefighter's trousers comprising forming firefighting protective material into a pair of leg sections and a torso section, providing a panel member of firefighting protective material, forming a crotch region in the firefighter's trousers by attaching the panel member of firefighting protective material to the leg sections and to the torso section, forming the torso section into a rear portion which has an upper edge, the method including providing a plurality of panel members, positioning a part of one of the panel members adjacent the upper edge of the rear portion of the torso section, the method also including forming a pair of spaced-apart stems in one of the panel members, and the method also including attaching one of the other panel members to the spaced-apart stems.

* * * * *